US007832704B1

(12) United States Patent
Sanders

(10) Patent No.: US 7,832,704 B1
(45) Date of Patent: Nov. 16, 2010

(54) CONCRETE FORM APPARATUS ADAPTED TO BE POSITIONED BETWEEN A CONCRETE BOARD AND A BASE BOARD IN A FOUNDATION

(75) Inventor: Michael G. Sanders, 20412 S. 4210 Rd., Claremore, OK (US) 74019

(73) Assignee: Michael G. Sanders, Claremore, OK (US)

( * ) Notice: Subject to any disclaimer, the term of this patent is extended or adjusted under 35 U.S.C. 154(b) by 972 days.

(21) Appl. No.: 11/624,486

(22) Filed: Jan. 18, 2007

(51) Int. Cl.
*E04G 17/06* (2006.01)

(52) U.S. Cl. ..... 249/216; 249/2

(58) Field of Classification Search ..... 52/741.15, 52/741.13; 249/34, 2–7, 208, 216; 264/31
See application file for complete search history.

(56) References Cited

U.S. PATENT DOCUMENTS 963,776 A * 7/1910 Kosack ..... 52/715
1,616,977 A * 2/1927 Koivu ..... 52/426
2,298,837 A 10/1942 Oswald
4,222,197 A * 9/1980 Johnson ..... 47/33
4,635,895 A * 1/1987 Johnson et al. ..... 249/5
4,834,929 A * 5/1989 Dehoff et al. ..... 264/226
4,836,487 A * 6/1989 Ringler ..... 248/303
4,879,855 A 11/1989 Berrenberg
5,174,083 A * 12/1992 Mussell ..... 52/169.1
5,817,247 A 10/1998 Colatruglio
D429,624 S * 8/2000 Johnson ..... D8/354
6,397,538 B1 6/2002 Phillips
6,536,737 B1 3/2003 Davis
6,705,583 B2 * 3/2004 Daniels et al. ..... 249/34
7,000,358 B2 2/2006 Clapp
7,051,988 B2 5/2006 Shaw et al.
7,097,147 B2 8/2006 Shaw et al.
7,108,453 B2 9/2006 Harris
7,131,624 B2 * 11/2006 Bogrett ..... 249/4
7,467,777 B2 * 12/2008 Huber et al. ..... 249/214

* cited by examiner

*Primary Examiner*—Janet M Wilkens
(74) *Attorney, Agent, or Firm*—Head, Johnson & Kachigian, P.C.

(57) ABSTRACT

A concrete form apparatus adapted to brace a concrete board and a base board in a foundation. The concrete form apparatus includes a plurality of leg members, a linking member and a concrete board support. At least one of the leg members is adapted to be positioned against the base board, while at least one of the leg members is adapted to be positioned against the concrete board. The concrete board support is attached to a top portion of one of the leg members and is adapted to secure the concrete board parallel to the base board. The concrete form apparatus may also include a removal mechanism to aid in the removal of the device, and it may also include at aperture through which a fastening device may be directed to secure the device to the base board. The present invention is modular and reusable.

7 Claims, 2 Drawing Sheets

FIG. 2
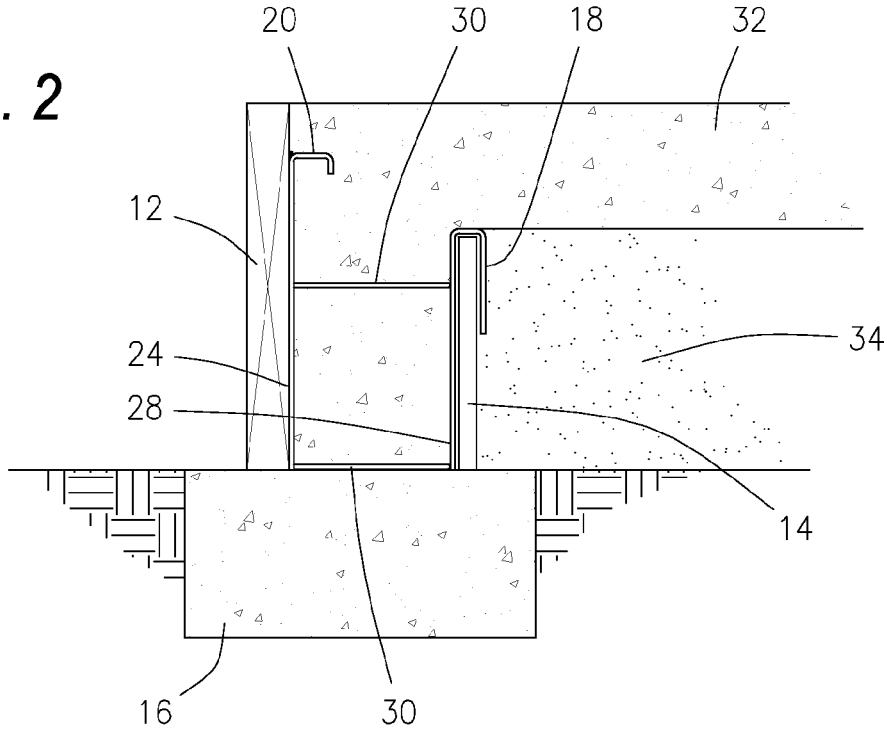
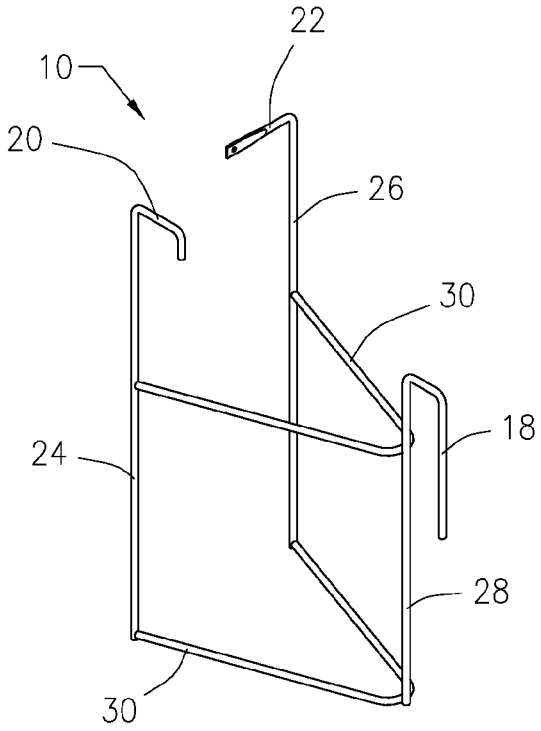
FIG. 3
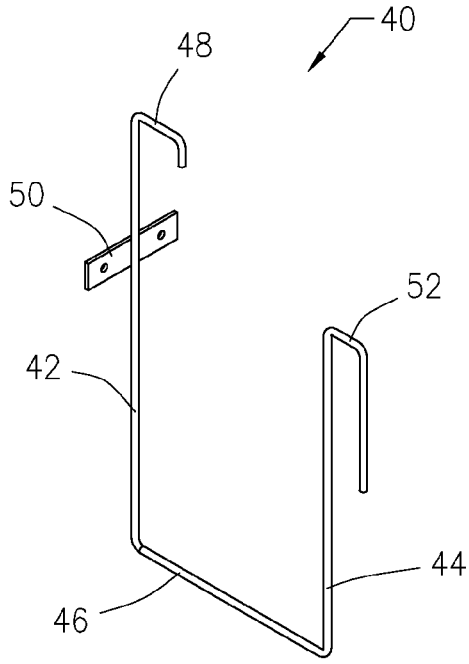
FIG. 4

CONCRETE FORM APPARATUS ADAPTED TO BE POSITIONED BETWEEN A CONCRETE BOARD AND A BASE BOARD IN A FOUNDATION

BACKGROUND OF THE INVENTION

1. Field of the Invention

The present invention is related to concrete construction materials for use in the laying of concrete foundations, and, more particularly, a concrete form apparatus to be positioned between a base board set up at the periphery of the foundation and a concrete board set up within the periphery of the base board for retaining a fill material.

2. Prior Art

The majority of residential homes being built currently have concrete slab foundations with vertical boards set up around the periphery of the foundation along a concrete footing. Wood 2×s are the most common material used for the base boards. Typically, the base boards are supported and secured to the foundation by a wood or steel angle support. Under the prior art, within the periphery of the base boards, a fill material, typically sand, is placed and graded or sloped downward toward the base board. Concrete is poured within the frame and over the fill material creating the foundation and corresponding concrete walls. After the concrete has cured, the base boards are pulled away from the foundation.

Under the present invention, instead of sloping the material toward the bottom portion of the base board, the present invention is placed so that it abuts the base board on one end and supports a concrete board at the opposing end. The fill material is then placed within the periphery of concrete board. Thus, a concrete form is created between the base board and the concrete board. Concrete is then poured into the form area and over the fill material. Before the concrete can cure, the apparatus of the present invention is removed so that it may be reused in another foundation.

The prior art includes various adjustable, as well as non-adjustable concrete from supporting brackets. The majority of this prior art relates to supporting structures that utilize stakes and wedges for retaining their position. Typically, the supporting structures comprise rigid right triangular members. Thus, there is a need for a brace which can be used to secure concrete forms ala work site and which overcomes the drawbacks of the prior art, such as those described above. It would be advantageous to provide a reusable concrete form apparatus which provides all the functions of the prior art, is less expensively, and has the functionality to save the amount of concrete required for a foundation. The apparatus of the present invention may also be used in an alternative manner that is particularly advantageous in some situations and is not available with the prior art devices. An additional advantage of the present invention is that it lessens the amount of concrete required for a typical foundation, and thus allowing builders to save money and time.

SUMMARY OF THE INVENTION

The present invention provides an improved concrete form apparatus adapted to be positioned between a base board and a concrete board in a building foundation. When the present invention is utilized during a foundation pour, the builder will save a significant amount of concrete and thus decrease the cost associated with pouring the foundation. For example, when the present apparatus is utilized for a 2500 square foot foundation, the foundation will require approximately seven (7) to eight (8) cubic yards less concrete than had the apparatus not been utilized. Given the rising prices of concrete, this could result in significant savings that may be passed on to consumers or may the builder's profit margin.

The concrete form apparatus contemplated by the embodiments of the present invention comprises a plurality of parallel leg members connected together by at least one linking member. Preferably, the linking member is perpendicular to the leg members. The present invention further comprises a concrete support member which secures a concrete board to the apparatus. The concrete board is used to retain the fill material of a foundation, typically sand, away from the outside base boards. The concrete support member is attached to a top portion of one of the leg members, and this leg member is positioned against the concrete board located within the periphery of the base board. Under the present invention, at least one of the leg members is adapted to be positioned against the base board that surrounds the outer edge of the foundation. When the apparatus of the present invention is utilized, the base board and concrete board are aligned in parallel, thus forming a well within which concrete is poured.

The present invention may also include a removal mechanism for removing the device from the well prior to the concrete curing, allowing the apparatus to be reused on the next job site. The removal mechanism is preferably attached to and integral with a top portion of one of the leg members. Also proximate with a top portion of one of the leg members is at least one aperture through which a fastening device such as a nail may be directed to secure the apparatus to the base board. It will be appreciated that the fastening device is not needed once the apparatus is finally installed because the fill material located within the boundaries of the concrete board will force the apparatus against the base board, and not allow it to shift or move while the concrete is poured.

In one embodiment, the apparatus has three leg members that are aligned in parallel, with at least one linking member attaching the three leg members. Two of the leg members have a planar alignment and are adapted to be positioned against the base board, while the third leg member is offset and adapted to be positioned against the concrete board. A concrete support member is attached to and integral with a top portion of the leg member adapted to be positioned against a concrete board. A removal mechanism is attached to and integral with a top portion of one of the leg members positioned against the base board, while the remaining leg member includes an aperture proximate to the top portion for fastening the apparatus to the base board. The leg members may be joined by one or more linking members, which are preferably perpendicular to the leg members. The apparatus forms a jointed structure having a truss-like, open build web construction.

Those skilled in the art will appreciate that the present invention may be constructed using only one or two leg members, however, for support, rigidity and stability, at least three leg members is preferred. Those skilled in the art will further appreciate that the removal mechanism may take numerous forms as long as it allows the apparatus to be removed from the concrete prior to it completely curing, for example, the removal mechanism may be a hook capable of receiving the claw of a hammer. Also, those skilled in the art will appreciate that the concrete support member may be designed in any way to cause the concrete board to rest securely against one of the leg members. Preferably, the concrete support member comprises an inverted U-shape bracket to maintain the position of the concrete board.

Other exemplary embodiments and advantages of the present invention may be ascertained by reviewing the present disclosure and the accompanying drawings.

BRIEF DESCRIPTION OF THE DRAWINGS

FIG. 2 is a side perspective view of an embodiment of the present invention in a usual arrangement positioned between a base board and a concrete board in a foundation;

FIG. 3 is a perspective view of an exemplary embodiment of the present invention; and FIG. 4 is a perspective view of an alternate embodiment of the present invention.

DETAILED DESCRIPTION OF THE PREFERRED EMBODIMENTS

Figure 1:
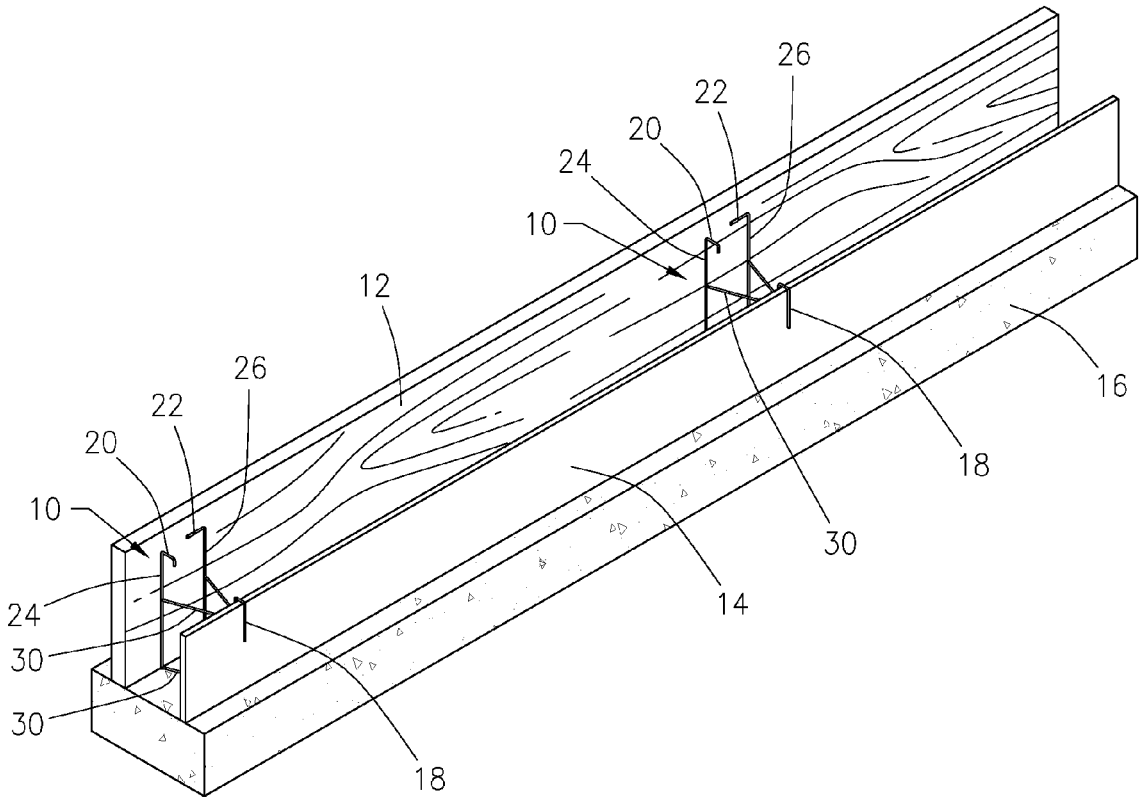
FIG. 1 is a perspective view of an embodiment of the present invention in a usual arrangement positioned between a base board and a concrete board in a foundation.

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

FIG. 1 illustrates an embodiment of the present invention positioned between a base board and a concrete board. In this embodiment, concrete form apparatus 10 comprises a plurality of leg members 24, 26 and 28 (not shown). Leg members 24 and 26 are adapted to be positioned against a base board 12, while leg member 28 (not shown) is adapted to be positioned against a concrete board 14. Linking member 30 connects leg members 24, 26 and 28, forming a jointed structure having a truss-like, open built web construction. A concrete board support 18 is attached to or integral with a top portion of leg member 28. Concrete board support 18 is adapted to secure concrete, board 14 parallel to base board 12. Those skilled in the art will appreciate that concrete board support 18 may take on numerous shapes and forms; however, preferably concrete board support 18 takes on the form of a bracket used to secure the concrete board 14 firmly against leg member 28.

Concrete form apparatus 10 rests upon a concrete footing 16, which is poured prior to the erection of the base boards 12 that surround the periphery of the to be poured foundation. The base boards 12 are arranged above the concrete tooting 16 in known manners, such as using a wooden stake to firmly secure the base boards 12 into ground. The base boards 12 are comprised of common material, such as wood 2×s. The concrete board 14, or sometimes known as cement board, is also a common material, typically comprising concrete and fiberglass, commonly used as a tile backing material.

Also present on the embodiment illustrated in FIG. 1 is a removal mechanism 20 attached to or integral with a top portion of leg member 24, 26 or 28. In this embodiment, the removal mechanism 20 is attached to leg member 24. Those skilled in the art will appreciate that removal mechanism 20 may be positioned at any location on concrete form apparatus 10 so long as removal mechanism 20 is accessible by a builder so that he/she may remove and reuse the concrete form apparatus 10 prior to the foundation curing. Those skilled in the art will also appreciate that removal mechanism 20 may take on numerous embodiments. In this embodiment, removal mechanism 20 is a hook wherein the claw of a hammer may be used to remove concrete form apparatus 10; but again, it should be appreciated that removal mechanism 20 may take on various embodiments in keeping with the scope and spirit of the present invention.

Also shown on the embodiment illustrated in FIG. 1 is an aperture 22 proximate to the top portion of leg members 24, 26 or 28 through which a fastening device (not shown) may be directed to secure the concrete form apparatus 10 to the base board 12. In this embodiment, aperture 22 is located near a top portion of leg member 26. Just as with the removal mechanism 20, those skilled in the art will appreciate that aperture 22 may be positioned at any location on concrete form apparatus 10 so long as it is accessible by the builder and allows the concrete form apparatus 10 to be secured to the base board 12. In keeping with the scope and spirit of the embodiments of the present invention, the fastening device may any device commonly used to secure one object to another, such as a nail, staple, etc.

FIG. 2 is a side perspective view of an embodiment of the concrete form apparatus 10 in a usual arrangement positioned between a base board 12 and a concrete board 14 with a foundation 32 having been poured. The concrete form apparatus 10, the base board 12 and the concrete board 14 are all positioned above a pre-poured concrete toting 16. In this embodiment, leg member 24 and leg member 26 (not shown) are adapted to be positioned against the base board 12 and leg member 28 is adapted to be positioned against the concrete board 14. Leg member 28 includes concrete board support 18, which is adapted to secure concrete board 14 parallel to base board 12. Concrete board 14 serves to retain a back fill material 34 from the concrete form apparatus 10 and the base board 12. Back fill material 34 may be of any material typically used as a fill material in foundations, such as sand. Concrete form apparatus 10 includes two (2) linking members 30 that join leg members 24, 26 (not shown) and 28 together to form a sturdy, jointed structure. Leg members 24, 26 and 28 are parallel, while leg members 24 and 26 are aligned along the same vertical plane. Linking members 30 are joined perpendicularly to leg members 24, 26 and 28. Those skilled in the art will appreciate that the spatial arrangements leg members 24, 26 and 28 and linking members 30 may be of other geometries. This embodiment also includes removal mechanism 20 attached to a top portion of leg member 24 which allows the builder to remove the concrete form apparatus 10 prior to foundation 32 fully curing.

FIG. 3 shows the preferred embodiment of concrete pouring apparatus 10 comprising leg members 24, 26 and 28, wherein the leg members 24, 26 and 28 are joined via linking members 30. Leg members 24 and 26 are aligned along the same plane and are adapted to be positioned against a base board (not shown). Leg member 28 is adapted to be positioned against a concrete board (not shown). Leg members 24, 26 and 28 are all in parallel alignment, while linking members 30 are attached to the leg members 24, 26 and 28 to form a right angle. Those skilled in the art will appreciate that more or less linking members 30 may be used to attached leg members 24, 26 and 28. Those skilled in the art will also appreciate that the angle at which linking members 30 intersect leg members 24, 26 and 28 may be at any angle greater than zero. A concrete board support 18 is attached to and integral with a top portion of leg member 28 and serves to secure and maintain the concrete board and base board in parallel alignment. In this embodiment, concrete board support 18 comprises an inverted U-shaped bracket firmly securing the concrete board against leg member 28. A removal mechanism 20 is attached to and integral with a top segment of leg member 24 and serves as a means to remove the concrete form apparatus 10 so that it may be reused on another foundation pour. In this embodiment, removal mechanism 20 comprises a hook. Also shown near a top segment of leg member 26 in FIG. 3 is an aperture 22 through which a fastening device (not shown) may be directed to secure the concrete form apparatus 10 to the base board. Aperture 22 in conjunction with the fastening device ensure the concrete form apparatus 10 will not shift or move prior to the back till material be placed within the perimeter of the concrete board or prior to the foundation being poured. Those skilled in the art will appreciate that the aperture 22 and corresponding fastening device are not a required element of the concrete form apparatus 10. Once a back fill material is placed within the periphery of the concrete board, the weight and corresponding force of the fill material on the concrete board will cause the concrete form apparatus 10 to securely abut the base board, and thus not allowing the concrete form apparatus 10 to freely move or shift.

FIG. 4 shows an alternate embodiment of the present invention. Concrete form apparatus 40 comprises a first vertical leg member 42 adapted to be positioned against a base board (not shown), a second vertical leg 44 member adapted to be positioned against a concrete board (not shown), and at least one horizontal support member 46 attaching the first vertical leg member 42 and the second vertical leg member 44. One end of the first vertical leg member 42 includes a removal mechanism 48 to aid in the removal of the concrete form apparatus 40. First vertical leg member 42 may also include at least one fastening bracket 50 through which a fastening device (not shown) may be directed in order to immobilize and secure the concrete form apparatus 40. One end 52 of the second vertical leg 44 is adapted to secure a concrete board. Those skilled in the art will appreciate that the embodiment depicted in FIG. 4 is not as stable or rigid as the embodiments depicted in FIG. 1, 2 or 3.

As previously mentioned, the embodiments of the present invention may be constructed with as few as one leg member, however for stability, rigidity and support concerns, it is preferred that the present invention comprise a plurality of leg members. Also as aforementioned, the present invention must comprise at least one linking member, however, the more linking members that join the leg members, the more stable the apparatus will be.

Those skilled in the art will appreciate the optional nature of the removal mechanism. Further, those skilled in the art will appreciate that the device may or may not include an aperture used to secure the apparatus. If the builder desires a means to secure the device, one or more apertures may be constructed on the device. In keeping with the spirit and scope of the embodiments of the present invention, those skilled in the art will appreciate that the concrete board support may take on numerous embodiments so long as it maintains the functionality of securing a concrete board to one of the leg members on the apparatus.

Furthermore, those skilled in the art will appreciate that the concrete form apparatus disclosed in the embodiments of the present application may be constructed of any rigid, durable and resilient material, including but not limited to, non-reactive plastic, wire cable or rod.

Whereas, the present invention has been described in relation to the drawings attached hereto, it should be understood that other and further modifications, apart from those shown or suggested herein, may be made within the spirit and scope of this invention.

What is claimed is:

1. A concrete form apparatus, comprising:

a first vertical support member adapted to be positioned against a concrete board, wherein an upper terminal end of the first vertical support member includes an inverted U-shaped bracket adapted to secure the concrete board;

a second vertical support member adapted to be positioned against a base board, wherein an upper terminal end of the second vertical member includes a flattened portion having at least one aperture through which a fastening device may be directed to secure the concrete form apparatus to the base board;

a third vertical support member adapted to be positioned against the base board, wherein an upper terminal end of the third vertical support member includes a inverted U-shaped removal mechanism to aid in the removal of the concrete form apparatus;

a generally V-shaped, horizontal base support member secured to a lower terminal end of each of the first, the second and the third vertical support members; and a generally V-shaped, horizontal intermediate support member secured to each of the first, the second and the third vertical support members intermediate of the upper terminal end and the lower terminal end respectively.

2. The concrete form apparatus of claim 1 wherein the first, the second and the third support members and the base and the intermediate support members form a trussed structure.

3. A concrete form apparatus, comprising:

a plurality of leg members comprising at least a first leg member, a second leg member and a third leg member; and the first leg member having an outer face adapted to be positioned against an inner foundation board, and the first leg member having an inverted U-shaped bracket;

the second leg member having an outer face adapted to be positioned against an outer foundation board, and the second leg member having at least one aperture through which a fastening device may be directed to secure the concrete form apparatus to the outer foundation board; and the third leg member having an outer face adapted to be positioned against the outer foundation board, and the their leg member having an inverted U-shaped removal mechanism to aid in the removal of the concrete form apparatus;

a plurality of linking members attached to the plurality of leg members, the plurality of linking members comprising at least a lower linking member and an upper linking member;

wherein the first, the second and the third support members are aligned in parallel, wherein the second and the third support members have a planar alignment, and wherein the base support member is parallel to the intermediate support member, and wherein the base support member and the intermediate support member are substantially perpendicular to the first, the second and the third vertical support members.

4. The concrete form apparatus of claim 3 wherein the removal mechanism is attached to or integral with an upper terminal portion of the third leg member.

5. The concrete form apparatus of claim 3 wherein the at least one aperture is proximate an upper terminal portion of the second leg member.

6. The concrete form apparatus of claim 3 wherein the bracket is attached to or integral with an upper terminal portion of the first leg member.

7. The concrete form apparatus of claim 3 wherein the plurality of leg members and the plurality of linking members form a trussed structure.

* * * * *